United States Patent [19]

Gray

[11] 4,120,444

[45] Oct. 17, 1978

[54] SECURING DEVICES

[76] Inventor: Lionel Cedric Nall Gray, Great Woodland Farm, Lyminge, Folkestone, Kent, CT18 8DW, England

[21] Appl. No.: 782,964

[22] Filed: Mar. 30, 1977

[51] Int. Cl.[2] ..... B65D 5/44; A44B 21/00; B65D 21/02

[52] U.S. Cl. ..... 229/49; 24/81 BF; 206/511

[58] Field of Search ..... 229/49; 217/69, 65; 24/81 E, 81 BF; 52/489, 488, 483, 494, 495, 497, 498; 206/512, 511

[56] References Cited

U.S. PATENT DOCUMENTS

| | | | |
|---|---|---|---|
| 967,605 | 8/1910 | Brooks | 24/81 BF |
| 1,010,801 | 12/1911 | Rapp | 206/511 |
| 2,801,453 | 8/1957 | Melvin | 24/81 BF |
| 2,950,514 | 8/1960 | Small | 24/81 BF |

FOREIGN PATENT DOCUMENTS

| | | | |
|---|---|---|---|
| 1,087,516 | 8/1960 | Fed. Rep. of Germany | 229/49 |
| 1,436,626 | 11/1966 | France | 229/49 |
| 1,403,771 | 11/1965 | France | 229/49 |
| 360,023 | 3/1962 | Italy | 24/81 BF |

*Primary Examiner*—William Price
*Assistant Examiner*—Allan N. Shoap
*Attorney, Agent, or Firm*—Mawhinney & Mawhinney & Connors

[57] ABSTRACT

A clip is disclosed which can secure a corner of a box formed from a blank of suitable material of which the margin is folded to constitute a peripheral wall for the box, the ends of the two adjacent wall portions overlapping at each of the corners of the box and therefore requiring a securing device at each corner such as the clip disclosed herein if the box is not to collapse. The clip is in the form of a bifurcated member of resilient but self supporting material, preferably plastics material such as polyethylene or polyurethane, the two furcations being connected by a head portion. One furcation is shorter than the other and is adapted to fit inside and along the corner of the box, whilst the other longer furcation is adapted to extend along and outside of the corner of the box with its free end terminating in a foot portion which is adapted to accommodate the corner of the base of the box.

18 Claims, 9 Drawing Figures

Fig. 1.
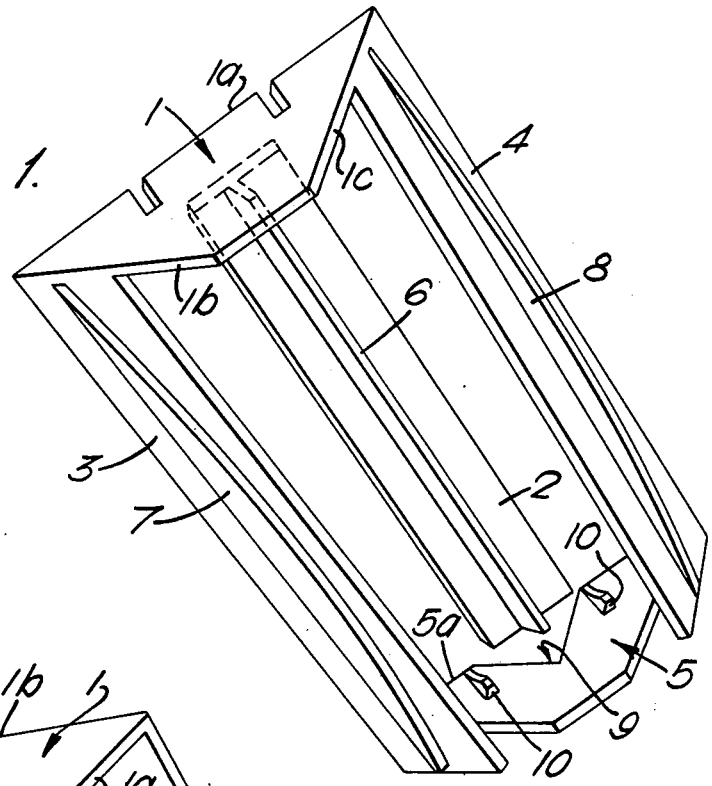
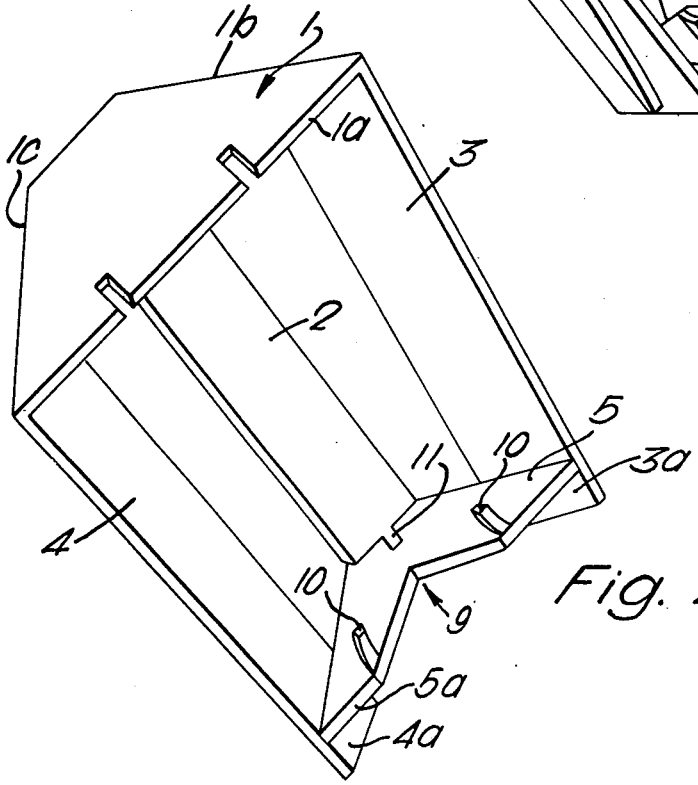
Fig. 2.

SECURING DEVICES

This invention relates to securing devices. It is primarily though not exclusively concerned with securing the corners of a box formed from a blank of fibre-board or other material of which the margin can be folded to form a box comprising a base and a marginal wall at the corners of which the ends of two wall portions overlap and require securing together to maintain the form of the box. The invention includes within its scope a clip which is suitable for securing such a box together and also the combination of a box or blank and clips for use therewith.

According to one aspect of the invention, there is provided a clip capable of fitment over a corner of the marginal wall of an open box, comprising a bifurcated member of a resilient, but self supporting material, of which one furcation is adapted to fit inside and along the corner of the box, and of which the other furcation is longer than the first furcation to which it is joined by a head, and is adapted to extend along and outside the corner, the free end of the longer furcation being formed as a foot which is positioned so as to accommodate the corner of the base of the box.

The term "head" is used herein to mean that part of a clip according to the invention to which both furcations are connected.

The clip may be secured into position by fitting the wall of the box at the corner between the furcations; variations in thickness of the overlapping portions of the box at the corner can be accommodated by the resilience of the clip and particularly of the inner furcation. This furcation may include an elongate strip which in use can span obliquely across the corner.

The provision of a foot which can partially fit round the head of a similar clip facilitates the secure stacking of boxes one upon the other. The foot may be formed with an internal rebate which can engage a complementarily shaped shoulder. However, other configurations of the foot and the head are possible.

According to another aspect of the invention there are provided a plurality of clips as described above in combination with a box blank having marginal parts delimited by lines of weakness and inwardly extending slots whereby the margins of the blank can be folded to form a perimeter wall surrounding a base, with the end portion of one marginal part overlapping an adjacent marginal part at each corner, the shorter furcation of each clip being slightly smaller than the inner height of the wall of the box, and combined height of the head, longer furcation and foot being greater than the height of the wall of the box so that when each clip is fitted over a respective corner of the folded blank, its shorter furcation fits inside and along the corner, its longer furcation extending along and outside the corner and its foot engages the underside of the corner of the base of the box.

Reference will now be made to the accompanying drawings which illustrate, by way of example, two embodiments of the invention and of which:

FIG. 1 shows a perspective view of the outer side of a clip according to one embodiment of the invention;

FIG. 2 shows a perspective view of the inner side of the clip of FIG. 1;

Figure 7:
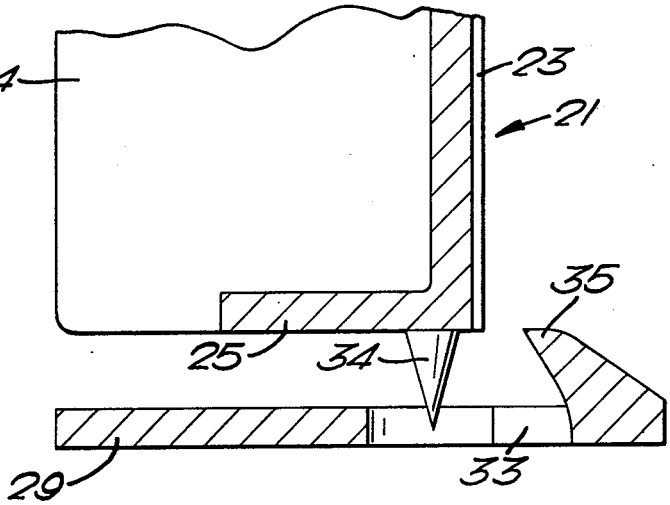
FIG. 7 shows a cross section on line VII—VII of FIG. 6.
Figure 8:
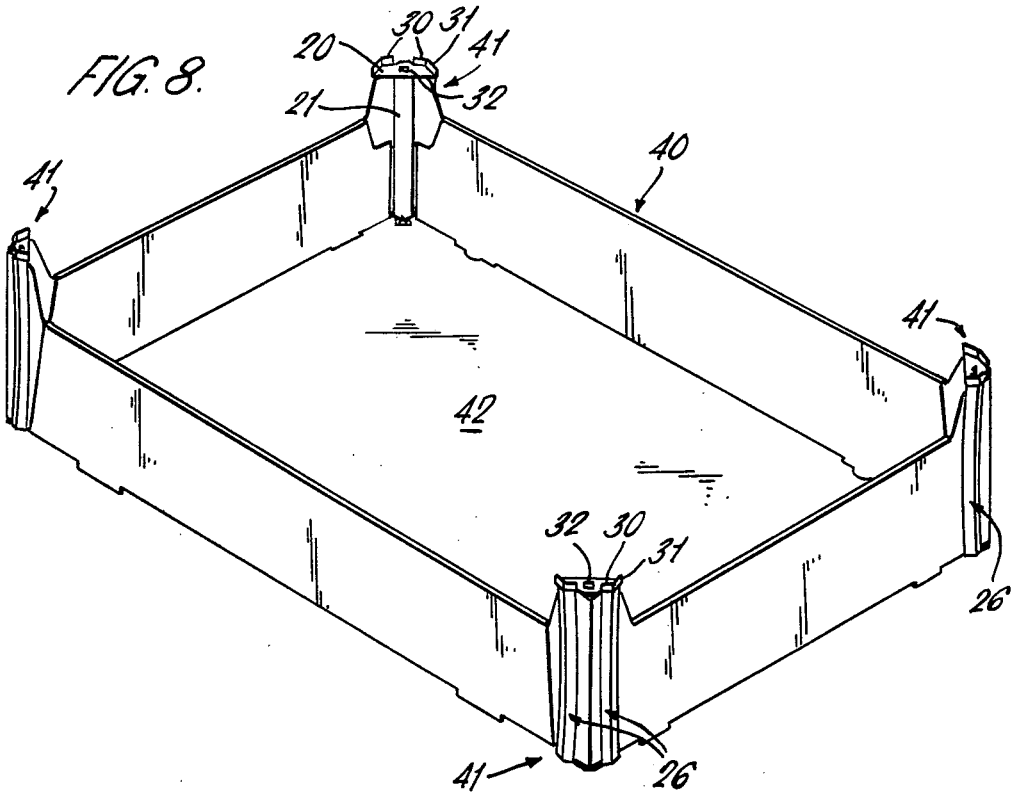
Figure 9:
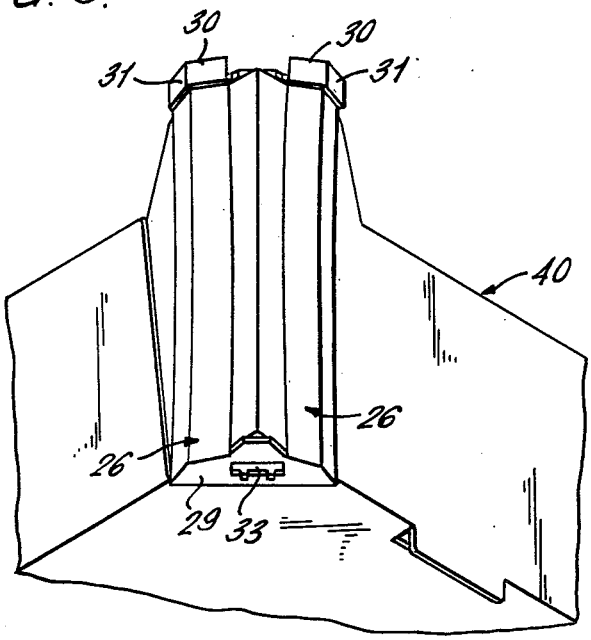

FIG. 8 shows a perspective view from above of a typical box blank when folded to form a rectangular box, each corner thereof being provided with a respective clip identical to that of FIGS. 3 to 7; and, FIG. 9 shows a perspective view from below one of the corners of the folded box blank of FIG. 8, illustrating the manner in which the foot of the clip mounted thereon engages and supports the underside of the base of a box at the corner.

According to one aspect of the invention, a box 40 (see FIGS. 8 and 9) is formed of a rectangular sheet of water-resistant fibreboard and clips as aforesaid. The fibreboard sheet typically comprises a central area 42, which will constitute the base of a finished box, and marginal portions of equal width separate from the central base area by lines of weakness, so as to form the sidewalls of the finished box when folded with respect to the central base area along the lines of weakness. Near each corner of the sheet there is a slot, parallel to one side of the sheet cut in the marginal portion so that at the corner the marginal portions can be bent inwardly with one marginal portion having a flap which extends along the inside of the adjacent marginal portion.

The marginal portions of the box at each of the four corners are connected together by a clip 41 according to the invention. Each clip is made of a semi-rigid, plastics material such as polyethylene or polyurethane or similar, and is integrally formed by, for example, injection moulding techniques.

One embodiment of such a clip will now be described with reference to FIGS. 1 and 2. The head of the clip in this particular embodiment comprises a plate 1 which has substantially the same shape of a 45° isoceles triangle of which the apex is truncated. A first elongate strip 2, constituting a first, inner furcation of the clip, extends away from a substantially central part of the underside of the plate 1, and is orientated parallel to the side 1*a* of plate 1 which constitutes the base of the triangle. Two further elongate strips 3 and 4, which together form a part of the second, outer furcation of the clip, extend from and are parallel to the other two sides 1*b* and 1*c* respectively of the triangular plate 1. The strips 3 and 4, which are longer than the strip 2 are interconnected below the free end of strip 2 by a second plate 5, having substantially the shape of an isoceles triangle of which one apex is truncated, the side 5*a* which constitutes the base of the triangle being parallel to the side 1*a* of plate 1. The strips 3 and 4 extend beyond the plate 5 so that the plate 5 and the projecting portions 3*a* and 4*a* of the strips together form a foot for the outer furcation of the clip which is shaped in a manner complementary to the plate 1. The spacing of the projecting portions 3*a* and 4*a* is somewhat greater than the corresponding dimension of plate 1 so that when the clip is fitted on the corner of a box, the box can be stacked on top of a similar box provided with similar clips with the heads of the clips of the lower box at least partially accommodated within feet of the corresponding clips on the upper box.

The inner furcation i.e. the first strip 2 is readily flexible but may be strengthened where necessary by a rib or ribs such as that shown at 6 in FIG. 1. The presence of the plate 5 between the strips 3 and 4 ensures that the outer furcation formed by these three members is substantially rigid. Further strengthening may be provided by means of ribs such as those shown at 7 and 8 in FIG. 1 on the strips 3 and 4. The clip may be pushed over a corner of the box, formed by folding the blank as described above, so that the inner furcation extends along and inside the corner with its longitudinal edges engaging the walls of the box on opposite sides of the corner. The outer furcation accommodates the arris of the corner, the base of the box being located on top of the plate 5. The fitting of the clip may be facilitated by the provision of a cutaway portion 9 in the side 5*a* of the plate 5 which can slide along the arris of the corner as the inner furcation is placed inside the corner. The retention of the flaps of the blank forming the corner by the resilience of the clip is preferably assisted by means of tapered projections 10 extending upwardly from the plate 5 which engage the underside of the base of the box and a corresponding projection 11 on the free end of strip 2 (FIG. 2) which engage the upper side of the base of the box.

Figure 5:
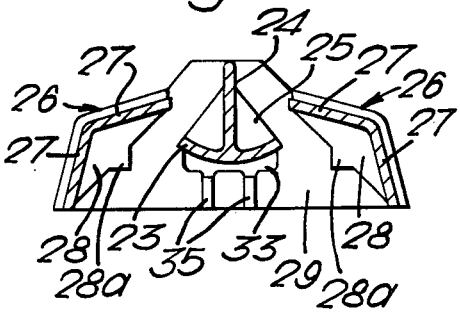
FIG. 5 shows a cross section on line V—V of the clip shown in FIG. 3.
Figure 6:
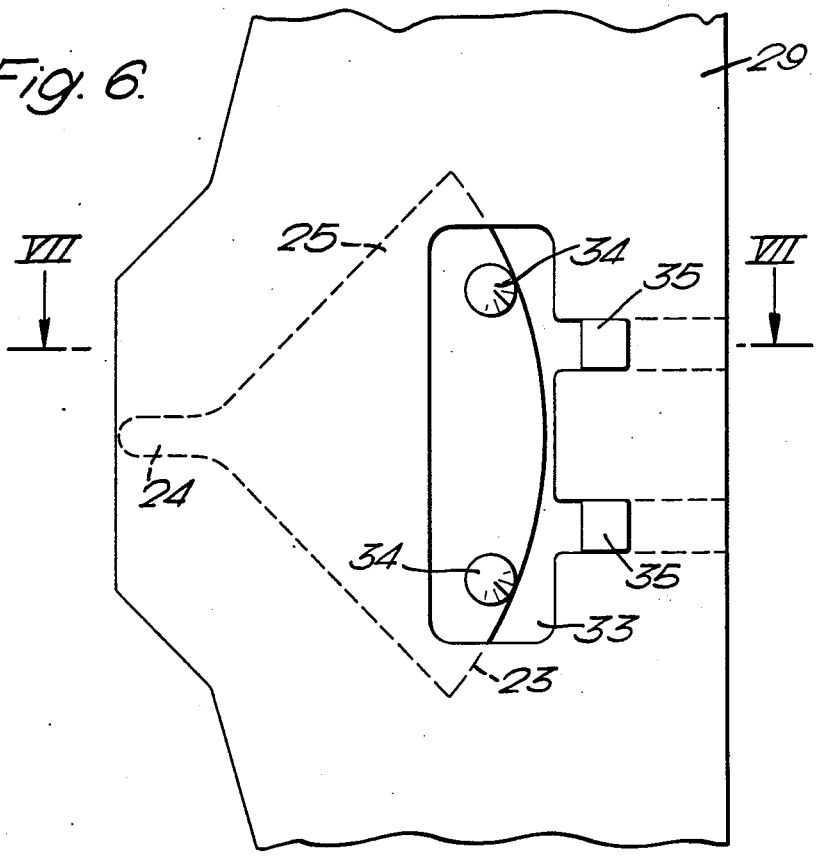
FIG. 6 shows a view of a part of the underside of the clip of FIG. 3 on an enlarged scale.

A second embodiment of a clip according to the invention is illustrated in FIGS. 3 to 7, and includes a plate 20, which interconnects a pair of elongate members or furcations 21 and 22. The furcation 21, which corresponds to the elongate strip 2 of the first embodiment, extends away from the underside of plate 20, and comprises an elongate strip 23 which is arcuate in cross section, as best seen in FIG. 5, and an elongate strip 24 also attached to the underside of the plate 20, a longitudinal edge of strip 24 being attached to the concave surface of strip 23 to strengthen the furcation 21. A web 25 extends between the strips 23 and 24 at the free end thereof, as seen in FIGS. 5 and 7 to inhibit distortion of the furcation 21 when the clip is fitted over a corner of the box as previously described.

Figure 3:
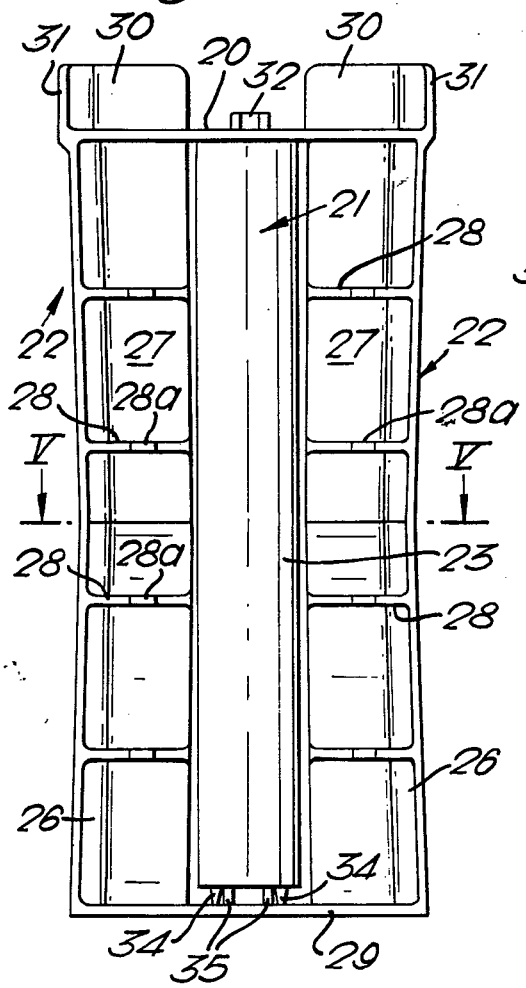
FIG. 3 shows an elevational view of the inner side of a clip according to a second embodiment of the invention.
Figure 4:
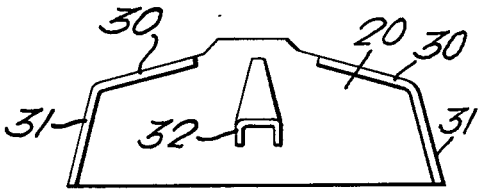
FIG. 4 shows a top view of the clip of FIG. 3.

The second furcation 22 comprises a pair of elongate hollow columns 26, corresponding to the strips 3 and 4 of the first embodiment, and extending away from two generally opposed sides of the plate 20. Each column 26 is longer than the furcation 21, and comprises a pair of generally longitudinally extending flanges 27 oriented at an oblique angle to one another, as shown in FIG. 5. A number of transverse strengthening webs 28 extend between each pair of flanges 27, the webs 28 being spaced at intervals along the columns 26 (FIG. 3). A bottom plate 29 interconnects the free ends of the columns 26 below the free end of the furcation 21, the bottom plate 29 being parallel to and having substantially the same shape as the top plate 20, and constituting a foot for the clip.

Each flange 27 comprises a pair of strips joined end to end and oriented at an oblique angle to one another so that each strip is inclined to a plane normal to the plates 20 and 29 by a small angle, which in this embodiment is of the order of $1\frac{1}{2}°$, as illustrated in FIG. 3.

The two flanges 27 of each column project above the plate 20, so that the projecting portions 30, 31 thereof, form together with plate 20, a head for the clip which is shaped in a manner complementary to the foot or plate 29. The relative spacing of the projecting portions 30, 31 of the strips is greater than the corresponding dimension of plate 29, so that when the clip is fitted onto the corner of a box, the box can be stacked on top of a similar box provided with similar clips with the feet of the clips of the upper box at least partially accommodated between the projecting portions 31 of the heads of corresponding clips on the lower box. To assist in the stacking of boxes in this way, the upper surface of plate 20 is provided with an upstanding projection 32 and the foot or plate 29 is provided with a correspondingly shaped aperture 33, so that the projection 32 on the head of a clip on the lower box can be engaged within the aperture 33 in the foot of the corresponding clip on the upper box.

The clip according to this embodiment is fitted over the corner of a box in a similar fashion to the fitting of a clip described for the embodiment shown in FIGS. 1 and 2. That is to say the furcation 21 is flexed about its connection to top plate 20 as the clip is pushed over the corner, so that the furcation 21 extends along the inner surface of the corner with strip 24 accommodated within the corner and the arcuate strip 23 extending across the corner, and the columns 26 of the other furcation 22 engage the outer surfaces of the walls of the box adjacent the corner, as shown in FIG. 8. Finally the foot of the clip is engaged under the base of the box, as shown in FIG. 9. To assist in the retention of the clip on the box, the inner furcation 21 is provided with downwardly projecting members 34 which extend into the aperture 33 in the foot or plate 29, and the plate 29 is provided with upwardly projecting members 35, so that when the clip is located over the corner of the box, the members 34 pierce the base from above and lock into the aperture 33, and the members 35 pierce the base from below, and thus the material of the base of the box is deformed and thereby trapped between the members 34 and 35. Also, to improve the stability of the clip, the webs 28 are each provided with a spike 28*a* which grip the sides of the box adjacent the corner when the clip is fitted over the corner and the box is filled thereby producing an outward loading on the clip.

Although in the two embodiments described above the outer furcation 3, 4 or 22 comprises two members of which the free ends are interconnected for rigidity, it is also possible for the outer furcation to be formed by a single elongate strip which is right angled in cross section which surrounds the arris of the corner of the box when the clip is fitted thereon.

I claim:

1. A clip capable of fitment over a corner of the marginal wall of a box, comprising a bifurcated member of a resilient, but self supporting material, of which a first furcation is adapted to fit inside and along the corner of the box, and of which a second furcation is longer than the first furcation to which it is joined by a head portion and is adapted to extend along and outside the corner, the free end of the longer, second furcation being formed as a foot which is positioned so as to engage and thereby support the underside of the corner of the base of the box when the clip is fitted thereover, there being means permitting resilient flexure of the first furcation with respect to the second furcation in a direction away from the second furcation such that the flexing of said first furcation away from the second furcation permits the fitment of the clip over said corner, and the cessation of said flexure once the clip is fitted over said corner permits the first furcation to urge the corner towards engagement with said foot and said second furcation.

2. A clip as claimed in claim 1, in which the foot and the head portion are shaped for complementary engagement with the head portion and foot respectively of a similar clip.

3. A clip as claimed in claim 2, in which the foot is formed with an internal rebate which can accommodate the head of a similar clip.

4. A clip as claimed in claim 3, in which the first furcation includes an elongate strip which spans obliquely across the corner of the box when the clip is fitted over said corner thereof, in use.

5. A clip as claimed in claim 4, in which the elongate strip extends away from a substantially central portion of the underside of the head portion of the clip.

6. A clip as claimed in claim 1, in which the free end of the first furcation is provided with at least one projection extending therefrom towards the foot for piercing engagement of the base of the box to trap the base between the free end of the first furcation and said foot when the clip is fitted over a corner of said box in use.

7. A clip as claimed in claim 6, in which the foot is provided with at least one projection extending towards the free end of the first furcation for further piercing engagement with the base of a box when the clip is located over a corner thereof in use.

8. A plurality of clips as claimed in claim 1, in combination with a box blank having marginal parts delimited by lines of weakness and inwardly extending slots whereby the margins of the blank can be folded to form a perimeter wall surrounding a base, with the end portion of one marginal part overlapping an adjacent marginal part at each corner, there being one clip for each corner, the shorter, first furcation of each clip being slightly smaller than the inner height of the wall of the box, and the combined height of the head portion, longer, second furcation and foot being greater than the height of the wall of the box so that when each clip is fitted over a respective corner of the folded blank, its shorter, first furcation fits inside and along the corner, its longer, second furcation extends along and outside the corner and its foot engages the underside of the corner of the base of the box to retain the clip thereon.

9. A combination as claimed in claim 8, in which the perimeter wall of the box formed by the blank has four right-angled corners, and in which four of said clips are provided, the head portion and foot of each clip each including a plate of which the periphery has the shape of a 45° isosceles triangle of which the apex is truncated, the two plates being parallel, the longer, second furcation of each clip including a pair of elongate members which interconnect the two plates, each elongate member being connected to a respective side of each plate adjacent the truncated apex thereof.

10. A clip as claimed in claim 1, in which said means permitting said resilient flexure of the first furcation with respect to said second furcation comprises a flexible portion of said head portion which thus constitutes a hinge between the two furcations.

11. A clip capable of fitment over a corner of the marginal wall of an open box, comprising a bifurcated member of a resilient, but self supporting material, of which a first furcation is adapted to fit inside and along the corner of the box, and of which a second furcation is longer than the first furcation to which it is joined by a head portion and is adapted to extend along and outside the corner, the free end of the longer, second furcation being formed as a foot which is positioned so as to engage and thereby support the underside of the corner of the base of the box when the clip is fitted thereover, the head portion of the clip being formed with an internal rebate which can accommodate the foot of a similar clip, and there being means permitting the resilient flexure of the first furcation with respect to the second furcation in a direction away from the second furcation such that the flexing of said first furcation away from said second furcation permits the fitment of a clip over said corner, and the cessation of said flexure once the clip is fitted over said corner permits the first furcation to urge the corner towards engagement with said foot and said second furcation.

12. A clip as claimed in claim 11, in which the first furcation includes an elongate strip which spans obliquely across the corner of the box when the clip is fitted over said corner thereof in use.

13. A clip as claimed in claim 12, in which the elongate strip extends away from a substantially central portion of the underside of the head portion of the clip.

14. A clip as claimed in claim 11, in which the free end of the first furcation is provided with at least one projection extending therefrom towards the foot for piercing engagement with the base of a box to trap the base between the free end of the first furcation and the foot when the clip is fitted over a corner of said box in use.

15. A clip as claimed in claim 14, in which the foot is provided with at least one projection extending towards the free end of the first furcation for further piercing engagement with the base of a box when the clip is located over a corner thereof in use.

16. A plurality of clips as claimed in claim 11, in combination with a box blank having marginal parts delimited by lines of weakness and inwardly extending slots whereby the margins of a blank can be folded to form a perimeter wall surrounding a base, with the end portion of one marginal part overlapping an adjacent marginal part at each corner, there being one clip for each corner, the shorter, first furcation of each clip being slightly smaller than the inner height of the wall of the box, and the combined height of the head portion, longer, second furcation and foot being greater then the height of the wall of the box so that when each clip is fitted over a respective corner of the folded blank, its shorter, first furcation fits inside and along the corner, its longer, second furcation extends along and outside the corner and its foot engages the underside of the corner of the base of the box to retain the clip thereon.

17. A combination as claimed in claim 16, in which the perimeter wall of the box formed by the blank has four right-angled corners, and in which four of said clips are provided, the head portion and foot of each clip each including a plate of which the periphery has the shape of a 45° isosceles triangle of which the apex is truncated, the two plates being parallel, the longer, second furcation of each clip including a pair of elongate members which interconnect the two plates, each elongate member being connected to a respective side of each plate adjacent the truncated apex thereof.

18. A clip as claimed in claim 11, in which said means permitting resilient flexure of the first furcation with respect to said second furcation comprises a flexible portion of said head portion which thus constitutes a hinge between the two furcations.

* * * * *